US007771179B2

(12) United States Patent
Kubota et al.

(10) Patent No.: US 7,771,179 B2
(45) Date of Patent: Aug. 10, 2010

(54) TUBE PUMP, INK JET RECORDING DEVICE, AND INK FEEDING METHOD

(75) Inventors: Yuzuru Kubota, Chiba (JP); Fumiyoshi Iwase, Hamamatsu (JP)

(73) Assignee: Seiko Instruments Inc. (JP)

( * ) Notice: Subject to any disclaimer, the term of this patent is extended or adjusted under 35 U.S.C. 154(b) by 471 days.

(21) Appl. No.: 11/792,592

(22) PCT Filed: Sep. 30, 2005

(86) PCT No.: PCT/JP2005/018077

§ 371 (c)(1),
(2), (4) Date: Aug. 3, 2007

(87) PCT Pub. No.: WO2006/070518

PCT Pub. Date: Jun. 7, 2006

(65) Prior Publication Data

US 2007/0296744 A1 Dec. 27, 2007

(30) Foreign Application Priority Data

Dec. 28, 2004 (JP) ..... 2004-380227

(51) Int. Cl.
*F04B 43/08* (2006.01)
*F04B 43/12* (2006.01)
*F04B 45/06* (2006.01)

(52) U.S. Cl. ..... 417/474; 417/476; 417/477.1

(58) Field of Classification Search ..... 417/474
See application file for complete search history.

(56) References Cited

U.S. PATENT DOCUMENTS 6,599,106 B2 * 7/2003 Harada et al. ..... 417/412
6,918,748 B2 * 7/2005 Miyazawa ..... 417/410.1

FOREIGN PATENT DOCUMENTS

JP 2003 021081 1/2003
JP 2003 118147 4/2003

* cited by examiner

*Primary Examiner*—Matthew Luu
*Assistant Examiner*—Brian J Goldberg
(74) *Attorney, Agent, or Firm*—Adams & Wilks

(57) ABSTRACT

A tube pump includes: an elastic tube (14); a circular arc-shaped guiding member (16) for guiding the tube (14); and at least one pressing member (15) for pressing the tube (14) against the guide member (16). The tube pump is characterized by being provided with a recessed portion (17) in a portion of the guiding member (16), in which the tube (14) is not pressurized by the pressing member (15) and can be recessed. Thus, there can be provided a tube pump in which a negative pressure inside an ink supply passage (7) can be eliminated and air can be readily prevented from entering the ink supply passage (7) when the main tank (5) is replaced, and an ink jet recording device using the tube pump.

15 Claims, 5 Drawing Sheets

TUBE PUMP, INK JET RECORDING DEVICE, AND INK FEEDING METHOD

CROSS-REFERENCE TO RELATED APPLICATIONS

This application is a U.S. national stage application of International Application No. PCT/JP2005/018077, filed Sep. 30, 2005, claiming a priority date of Dec. 28, 2004, and published in a non-English language.

TECHNICAL FIELD

The present invention relates to a tube pump, and more particularly to a tube pump of an ink jet recording device for jetting ink droplets from a recording head to record an image onto a recording medium, which is used for supplying ink from a main tank serving as an ink supplying source to a sub-tank.

BACKGROUND ART

An ink jet recording device of a serial printing system as shown in FIG. 1 includes at least a delivery means for delivering a recording medium in a sub-scanning direction (not shown) and a recording head 1 which is mounted onto a carriage 2 and reciprocates in a main scanning direction orthogonal to the sub-scanning direction. The ink jet recording device has a structure for jetting ink droplets from the recording head 1 at a desired timing according to print data, and allowing the ink droplets to land on a surface of the recording medium, to thereby perform image formation.

In particular, a large ink jet recording device for forming a large image on a relatively large recording medium, which consumes a large amount of ink, includes as an ink supplying source a main tank 5 of a large capacity at an ink jet recording device main body side, and a sub-tank 9 in a midway of an ink supply passage connecting the main tank and the recording head, to thereby supply the ink to the recording head 1.

In the ink supply mechanism of this type, when a state where an amount of the ink sucked from the main tank 5 to the sub-tank 9 is decreased to a remaining amount L is detected by a sensor such as a reflective optical sensor, a pump 8 is allowed to rotate in a positive direction. Then, when a state where an amount of the ink sucked to the sub-tank 9 has satisfied a preferred amount H is detected by the sensor, the rotation of the pump 8 is stopped. In this ink supply mechanism, the ink is continuously sucked as appropriate from the main tank 5 to the sub-tank 9, so the ink amount in the sub-tank can be continuously kept between the remaining amount L and the preferred amount H. Further, the ink sucked to the sub-tank 9 can be stably supplied to a nozzle of the recording head 1.

The recording head in the recording device of this type applies pressure to the ink to jet and disperse the ink. Therefore, in a case where air bubbles are included in the ink, the pressurized state of the ink becomes unstable and jet performance of the ink droplets is lowered, thereby deteriorating a printing quality. Thus, there is adopted a structure in which ink from which dissolved air is eliminated is filled in the ink supply passages 7 and 12. To be specific, as for the main tank 5 serving as the ink supplying source, an ink cartridge in which ink that has been satisfactorily deaerated in a manufacturing process is sealed in a gas-barrier case 5*a* and in which the gas-barrier case 5*a* is further packaged is used. Further, as for the sub-tank 9, a flat ink enclosed-type sub-tank or the like is used, in which an ink bag having a flat shape is enclosed and an ink inlet port connected with the enclosed ink bag is formed on an upper end portion in a gravity direction, in order to fill the ink into the ink flow passage without leaving air in the sub-tank during an initial filling of the ink.

As means for supplying the ink from the main tank 5 to the sub-tank 9 as described above, a piston pump, a tube pump, or the like is employed. Of those, the tube pump is becoming a mainstream of suction means in recent years because a suction pressure, a suction amount, a suction velocity, and the like can be easily controlled and the tube pump can be readily manufactured (e.g., JP 11-190280 A).

As shown in FIG. 8, a general tube pump includes, for example, a circular arc-shaped guiding member 16, a tube 14 arranged on an inner circumference thereof, and at least one pressing member (roller) 15 that rotates while pressing the tube against the guiding member 16. The roller 15 moves while squeezing the tube 14, thereby delivering a liquid, a gas, and the like in the tube in a forward direction. It should be noted that, a rubber tube made of silicon rubber, fluororubber, or the like or an elastic resin tube can be used as the elastic tube.

However, in the above-mentioned ink supply mechanism, in the case where the suction pump 8 is allowed to rotate in the positive direction to continuously suck the ink from the main tank 5 to the sub-tank 9 even after the ink remaining amount in the main tank 5 becomes approximately zero, the ink supply passage 7 connecting the main tank 5 and the sub-tank 9, and the main tank 5 are in a negatively pressurized state. Further, when the main tank 5 is removed from the ink supply passage 7, air enters the ink supply passage 7 from an open portion of an ink supply passage 7*a* from which the main tank 5 has been removed. In addition, when the ink is sucked from the newly-mounted main tank 5 to the sub-tank 9 through the ink supply passage 7, the air that has entered the ink supply passage 7 is delivered to the sub-tank together with the ink. Then, the air that has entered the sub-tank 9 is delivered to the ink jet recording head 1 together with the ink, so the ink cannot be stably jetted.

To avoid this situation, it is possible that the main tank 5 is removed in a state where the ink still remains to some extent to prevent the inner portion of the ink supply passage 7 from being negatively pressurized. However, the main tank 5 is made of a flexible bag, so it is difficult to detect the ink remaining amount. Therefore, the main tank 5 may be replaced while still having a large amount of ink left, resulting in wasteful dumping of the ink.

Therefore, it is an object of the present invention to provide an ink jet recording device capable of preventing air from entering the ink supply passage 7 due to the negative pressure inside the ink supply passage 7 connecting the main tank 5 and the sub-tank 9 when the main tank is replaced, and fully using nearly the whole ink in the main tank 5 without waste until the ink remaining amount in the main tank 5 becomes approximately zero at the time of the replacement of the main tank.

DISCLOSURE OF THE INVENTION

A tube pump according to the present invention includes: a pump main body having a space portion defined therein, including: a circular arc-shaped guiding member formed on an inner circumference of the pump main body over a predetermined angle range; and an opening portion communicating with the space portion; a tube provided along the guiding member and led out from the opening portion; at least one pressing member rotationally driven around a shaft coaxial with the guiding member, for pressing the tube against the guiding member; driving means for controlling the rotational drive; and flow passage securing means provided to the guiding member to which the tube is provided. Accordingly, when the pump is stopped for replacing a main tank, negative pressure inside an ink supply passage and the main tank can be eliminated.

Further, in the tube pump of the present invention, the flow passage securing means is defined by at least one recessed portion of the guiding member, in which the tube is not pressed by the guiding member and the pressing member. Accordingly, during stoppage for replacing the main tank, the negative pressure inside the main tank can be eliminated with a simple mechanism and operation.

Further, in the tube pump of the present invention, the number of the pressing member is the same as the number of the recessed portion or larger than the number of the recessed portion by one. Accordingly, it is possible to reliably prevent air from entering the ink supply passage from atmosphere and to sufficiently exert pump efficiency required for supplying the ink.

Further, an ink jet recording device according to the present invention is an ink jet recording device for performing recording onto a recording medium by jetting ink from recording means, which includes a tube pump including: a pump main body having a space portion defined therein, including: a circular arc-shaped guiding member formed on an inner circumference of the pump main body over a predetermined angle range; and an opening portion communicating with the space portion; a tube inserted into the pump main body and provided along the guiding member and led out from the opening portion; at least one pressing member rotationally driven around a shaft coaxial with the guiding member, for pressing the tube against the guiding member; driving means for controlling the rotational drive; and flow passage securing means provided to the guiding member to which the tube is provided, to deliver the ink in an ink supply passage. Accordingly, it is possible to reliably prevent air from entering the ink supply passage from the atmosphere and to stably jet the ink from a nozzle of an ink jet recording head.

An ink supplying method according to the present invention includes: an ink remaining amount detecting step of detecting a state where an amount of ink sucked from a main tank to a sub-tank cannot satisfy a preferred amount even after a certain time period; a tube flow passage opening step of stopping, by position detection means for detecting a position of a pressing member and driving means for rotationally driving pressing means, the pressing member at a position where the pressing member opposes a recessed portion, and securing an ink flow passage inside the tube; and a tube closing step of stopping, by the position detection means and the driving means, the pressing member at a position where the pressing member opposes a portion of the guiding member other than the recessed portion, and closing the ink flow passage inside the tube. According to the method, when the main tank is replaced, it is impossible to eliminate the negative pressure inside the ink supply passage and effectively prevent air from entering.

BEST MODE FOR CARRYING OUT THE INVENTION

Figure 1:
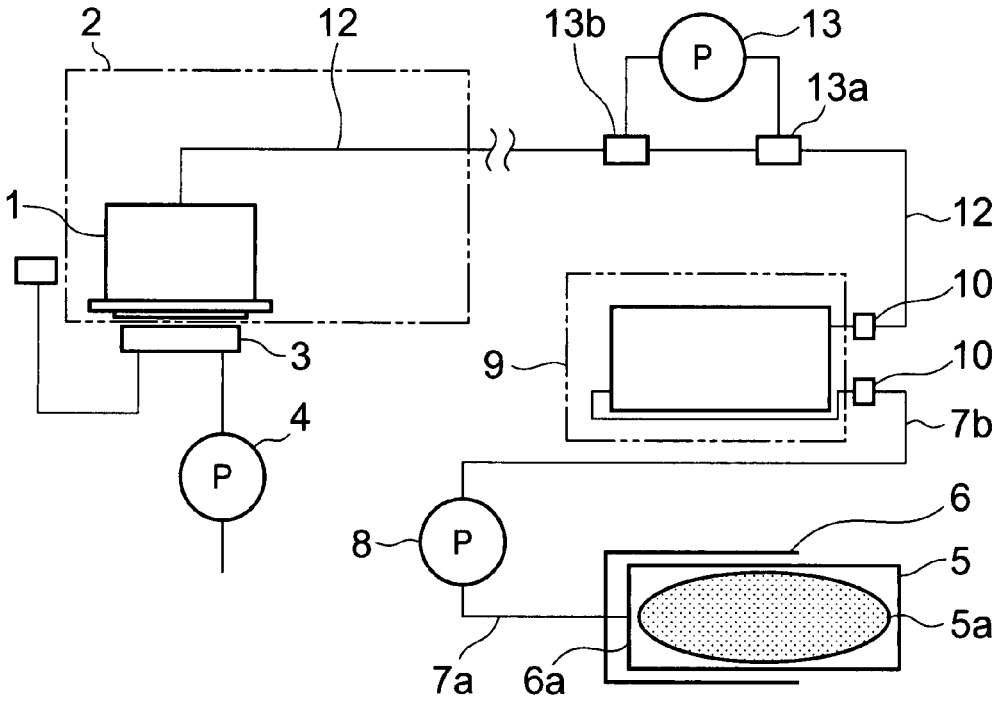
FIG. 1 is a diagram schematically showing a basic structure of ink supplying of an ink jet recording device according to an embodiment mode of the present invention.

Hereinafter, an embodiment mode of the present invention will be described by referring to the drawings.

FIG. 1 is a diagram schematically showing a basic structure of ink supplying of an ink jet recording device according to the present invention. In FIG. 1, a carriage 2 is mounted with a recording head 1 and is supported so as to be capable of reciprocating in a main scanning direction orthogonal to a delivering direction of a recording medium, on the recording medium (not shown) disposed below the recording head 1.

Further, outside an unprinted region in the main scanning direction, there is provided a service station for performing cleaning and the like of the recording head 1. The service station is provided with a capping section 3 for sealing a nozzle formation surface of the recording head 1. A negative pressure can be applied to the capping section 3 by using a suction pump 4. Further, the capping section 3 is provided with an atmosphere releasing valve so that a negatively pressurized state of the capping section 3 can be released. With the structure as described above, it is possible to remove contaminants and the like precipitated inside the recording head 1 (cleaning operation) and to execute an initial filling operation of the ink in the device.

A main tank 5 serving as an ink supplying source is structured so as to be capable of being mounted to a main tank storing portion 6 provided at a predetermined position in the device. The main tank 5 includes a gas-barrier case 5*a* capable of retaining ink which has been satisfactorily deaerated during an initial ink filling. In this example, the gas-barrier case 5*a* is a gusset-type bag-like ink package made of a flexible material, and an aluminum foil layer is provided as one layer of the flexible material, thereby securing a satisfactory gas-barrier property.

In addition, a septum (not shown) made of a rubber material is provided at a binding end of the gas-barrier case 5*a* and an ink supply passage. Therefore, the gas-barrier case 5*a* is detachably attached to the main tank storing portion 6 such that a deaeration rate of the deaerated ink retained in the gas-barrier case 5*a* is not lowered due to insertion binding of a needle 6*a* provided to the main-body main tank storing portion 6. The needle 6*a* provided to the main tank storing portion 6 is connected to an ink supply passage 7 made of a flexible tube. One end of the ink supply passage 7 is connected to a connecting member 10 provided to a distal end portion of a flexible tube extending from an ink inlet port of the sub-tank 9. It should be noted that a suction pump 8 for sucking the deaerated ink retained in the main tank 5 to the sub-tank 9 is provided in the midway of the ink supply passage 7. In the present invention, the following tube pump is used as the suction pump 8. The structure of the tube pump will be described later in detail.

The sub-tank 9 includes a flexible ink bag. Another connecting member 10 provided to a distal end portion of another flexible tube extending from an ink outlet port of the sub-tank 9 is connected to one end of an ink supply passage 12 made of a flexible tube, and another end of the ink supply passage 12 is connected to the recording head 1. In this embodiment mode, by attaching and detaching the ink supply passages 7 and 12 to and from the connecting members 10 provided in the vicinity of the ink inlet/outlet ports of the sub-tank 9, it is possible to easily mount and dismount the sub-tank 9 to and from a sub-tank holder (not shown) provided to a predetermined position of a main body. Further, in the midway of the ink supply passage 12, a pressuring pump 13 for preferably finishing a meniscus formed on a nozzle surface of the recording head 1 is provided so as to branch from the ink supply passage 12. Solenoid three-way valves 13*a* and 13*b* provided in the ink supply passage 12 are switched to be controlled so that the meniscus formed on the recording head 1 can be preferably finished.

According to the embodiment mode of FIG. 1, a structure including the recording head 1 adapted for monochrome printing has been described. Alternatively, in a case where an ink jet recording device has a structure including a multicolor printing/monochrome multirecording head, for example, a plurality of main tanks 5 and the same number of sub-tanks 9 may be provided so that they correspond to each other one by one to obtain an ink supply passage to the recording head 1. It is not intended to eliminate other embodiment modes as long as they conform to the gist of the present invention.

Figure 2:
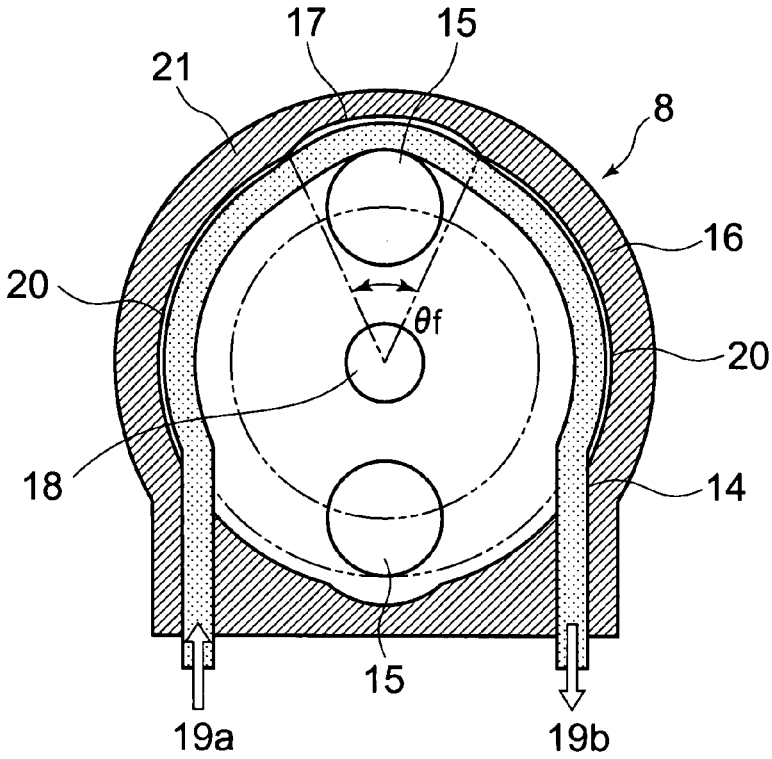
FIG. 2 is a schematic diagram showing a tube pump of the present invention.
Figure 3:
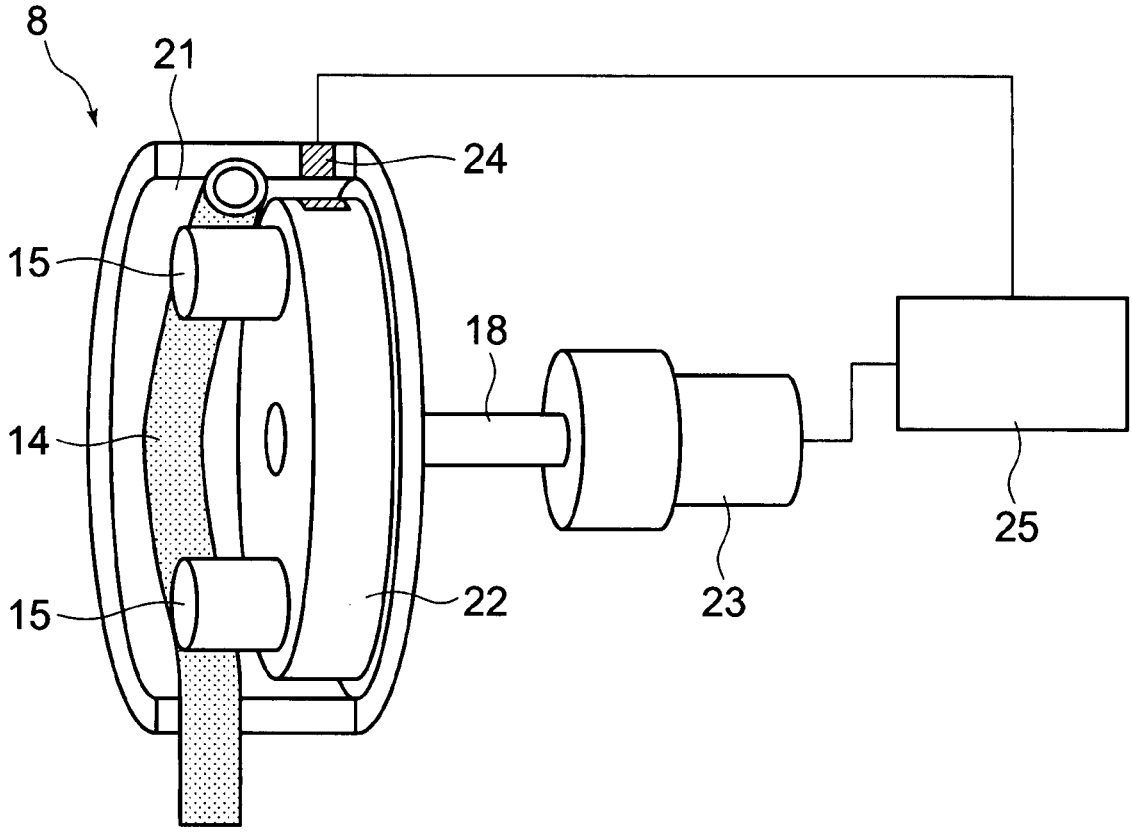
FIG. 3 is a diagram showing a control structure of the tube pump of the present invention.

FIG. 2 is a sectional diagram schematically showing a first embodiment of the tube pump 8 of the present invention for sucking ink in the main tank 5 to the sub-tank 9. Further, FIG. 3 is a diagram showing a control structure of the tube pump of the present invention. The tube pump of the present invention includes a pump main body 21 having a space portion defined therein, which includes a circular arc-shaped guiding member formed on an inner circumference of the pump main body 21 over a predetermined angle range and an opening portion that communicates with the space portion. Inside the space portion, there are arranged an elastic tube 14, a guiding member 16 which is a part of the pump main body, for guiding the tube 14 along the inner circumference, and rollers 15 serving as pressing members for pressing the tube 14 against the guiding member 16.

In the suction pump 8 of this embodiment, the above-mentioned predetermined angle is 180° or more, and the tube 14 is provided along the guiding member 16 having the predetermined angle so as to curve in an inverse-U shape. Further, the rollers 15 are rotatably fixed by a guide plate 22, and the guide plate 22 is supported by a pump shaft 18 and connected to a motor 23 controlled by a controller 25 to be rotationally driven. The predetermined angle is preferably 180° or more to secure more portions in which the tube 14 is pressed by the rollers 15 to improve pump efficiency. Further, in the case where there are two rollers 15, by defining the predetermined angle to be 180° or more, the tube 14 can be pressed constantly by one of the rollers 15.

In addition, in a portion of the guiding member 16 provided with the tube 14, there is defined a recessed portion 17 at which the tube 14 is not pressurized even when sandwiched between the roller 15 and the guiding member 16 and at which the tube 14 can be recessed. In a case where the roller 15 is stopped at a position opposing the recessed portion 17, a flow passage is not closed by the roller 15 and the guiding member 16 and a fluid such as ink in the tube pump can pass the recessed portion 17 to flow.

In a case where a volume of the recessed portion is small, it becomes difficult to stop the roller 15 so as to match the recessed portion depending on a control method, resulting in an insufficient amount of recess flow rate.

Meanwhile, in a case where the recessed portion 17 is too large, the pump efficiency is lowered, so the ink cannot be sufficiently sucked from the main tank 5 to the sub-tank 9. Further, in the case where the recessed portion is too large, it becomes difficult to lock the ink flow in the tube pump due to complete closure of the flow passage of the tube 14 by closing portions 20, which correspond to portions of the guiding member 16 except the recessed portion, and the rollers 15. Therefore, it is preferable that the recessed portion 17 have a recessed portion angle θf of about 30° to 90° depending on the above-mentioned predetermined angle, in a case where the pressured tube 14 has an angle of 180° or more and there is one recessed portion 17, and most preferably 50°.

When the rollers 15 are rotated around the pump shaft 18, a fluid such as a liquid and a gas existing inside the tube 14 is delivered. For example, in a case where the rollers 15 are rotated clockwise, the tube 14 at a tube end 19*a* side has a negative pressure, so the fluid existing in the tube end 19*a* is sucked into the tube 14. On the contrary, the tube 14 at a tube end 19*b* side has a positive pressure, so the fluid existing inside the tube 14 at the tube end 19*b* side is jetted from the tube end 19*b*. In other words, the fluid is delivered from the tube end 19*a* side to the tube end 19*b* side.

Figure 4:
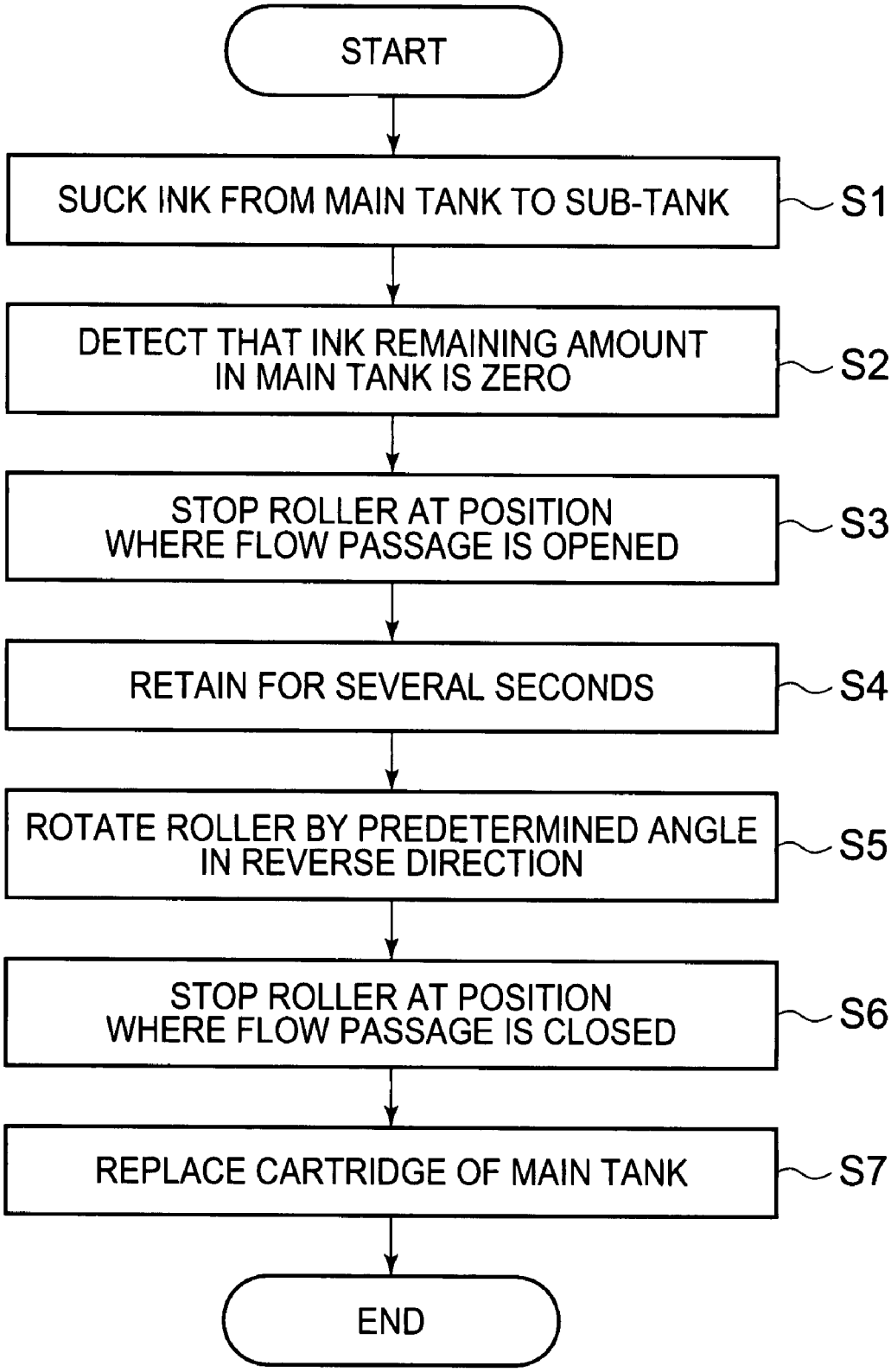
FIG. 4 is a flowchart of control in a case of replacing a main tank of the present invention.
Figure 5:
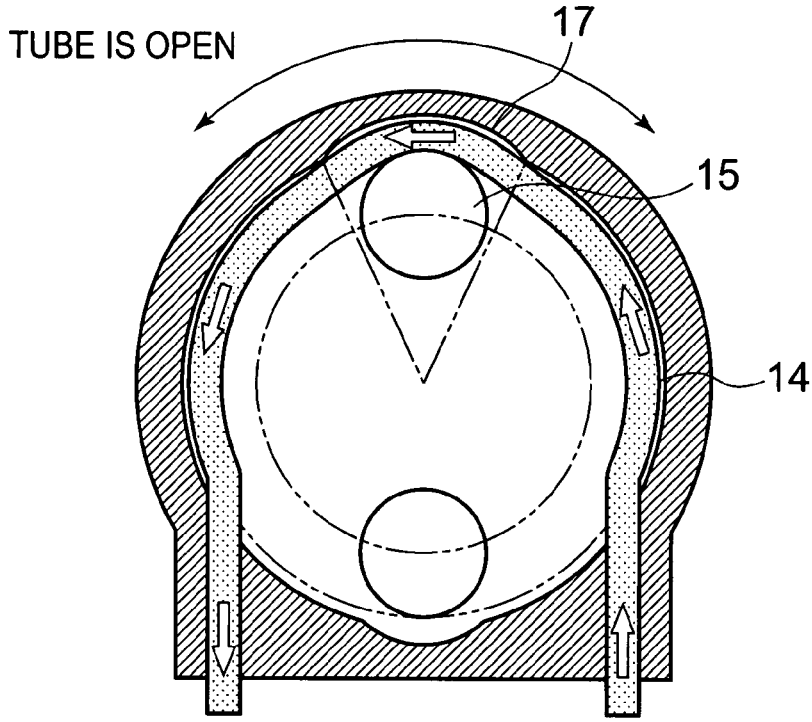
FIG. 5 is a schematic diagram showing the tube pump of the present invention in a case where a tube is open.
Figure 6:
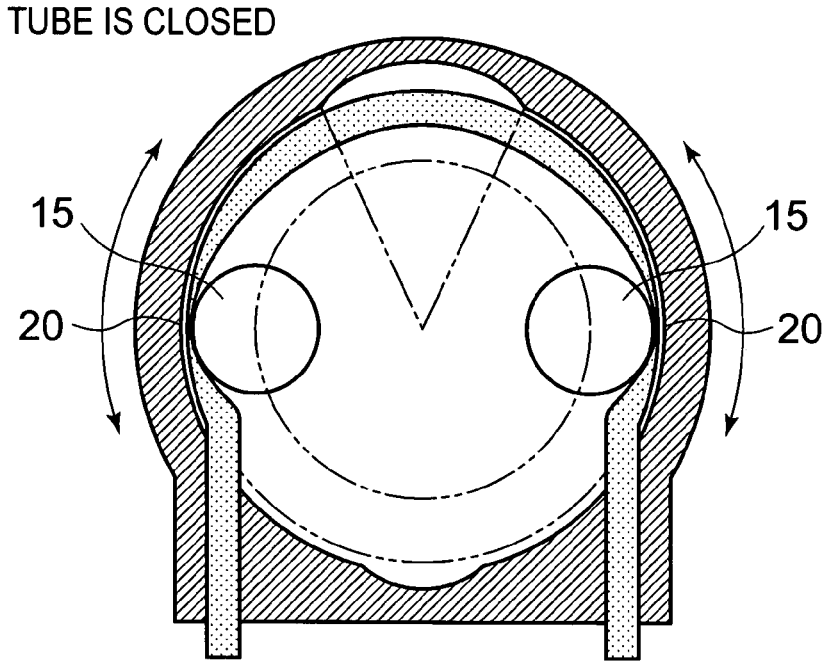
FIG. 6 is a schematic diagram showing the tube pump of the present invention in a case where the tube is closed.

Next, referring to a flowchart of FIG. 4, how the tube pump 8 is controlled in a case of replacing a cartridge of the main tank 5 is described. In a case where an amount of the ink sucked from the main tank 5 to the sub-tank 9 cannot satisfy a preferred amount H even after a certain time period, that is, in a case where an ink remaining amount in the main tank is approximately zero (S2), the rollers 15 are stopped at a position where one roller 15 opposes the recessed portion 17, that is, in a state (state shown in FIG. 5) where the ink flow passage is secured (open state) inside the tube 14 of the tube pump (S3). A position control of the stop position is performed through detection of a magnet attached to the guide plate 22 by a magnet sensor 24 (hole element) attached to the pump main body 21. Stop position information from the magnet sensor 24 is transmitted to the controller 25 to control the drive of the motor 23. The stop state of FIG. 5 is retained for several seconds (S4), with the result that an extremely small amount of the ink in the pump tube and the ink supply passage 7 in the sub-tank direction flows in the main tank direction as shown by the arrows, and the negative pressure inside the ink supply passage 7 can be eliminated. The retention period of the stop state is approximately three seconds although it depends on a length of the ink supply passage between the main tank 5 and the tube pump 8. After that, the rollers 15 are rotated by a predetermined angle in a reverse direction (S5), and then are stopped in a state shown in FIG. 6 in which the flow passage of the tube 14 is closed by the rollers 15 and the closing portions 20 which correspond to portions of the guiding member 16 except the recessed portion 17 (S6). Then, the cartridge of the main tank is replaced (S7).

By performing the control as described above, during stoppage for replacing the cartridge of the main tank, the negative pressure inside the ink supply passage 7 can be eliminated with the simple mechanism and operation. Further, it is possible to reliably prevent air from entering the ink supply passage 7 connecting the main tank 5 and the sub-tank 9 from the atmosphere when the cartridge of the main tank 5 is replaced. Accordingly, an ink jet recording device can be realized, in which the ink can be stably jetted from the nozzle of the ink jet recording head 1.

In addition, the sensor for position detection is not limited to one using a magnet. A rotary encoder, a touch sensor (microswitch), a photo sensor, or the like can also be used.

Figure 7:
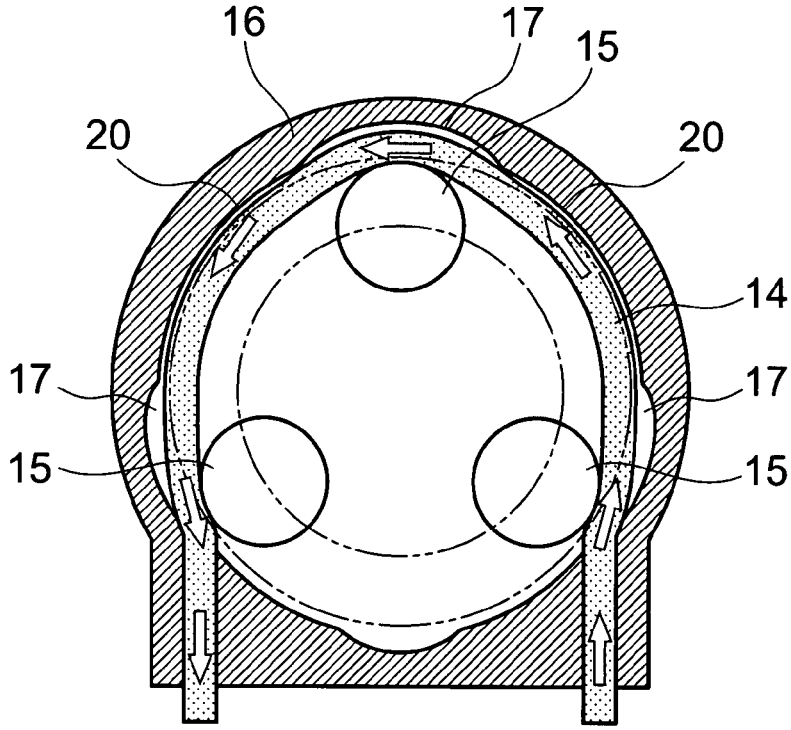
FIG. 7 is a schematic diagram of a second embodiment of the present invention.
Figure 8:
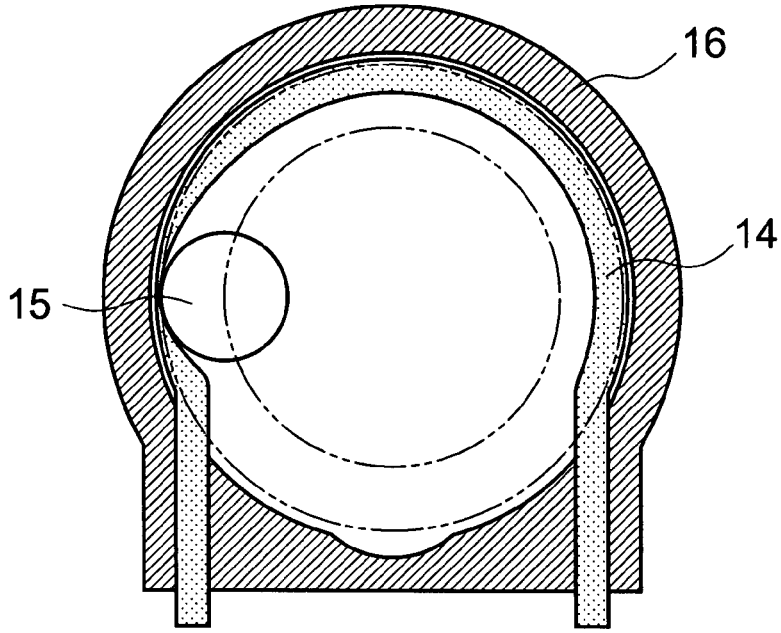
FIG. 8 is a schematic diagram showing a conventional tube pump.

Next, the number of the rollers 15 to be used in the tube pump 8 of the present invention will be described. The number of rollers used in the tube pump of the present invention is at least one. However, in the case where there is one roller, even when a rotation number of the pump is increased, the pressure may not exceed a predetermined value, with the result that the ink cannot be sucked sufficiently from the main tank 5 to the sub-tank 9. In addition, when the pump is stopped and the ink flow passage is closed (locked) to stop the flow of the ink, an amount of pressured deformation cannot be secured due to a loosened shaft or the like, so a leak may occur. Thus, it is desirable that two or more rollers be used for the tube pump 8 of the present invention. Further, in a case where three or more rollers are provided, it is desirable that a plurality of recessed portion 17 be provided. As to the relation between the number of rollers and the number of the recessed portions, it is preferable that those numbers be the same or the number of rollers be larger than the number of recessed portions by one. As a result, in the case where the tube flow passage is open, the ink flow passage can be secured to eliminate the negative pressure inside the ink supply passage 7, and in the case where the tube flow passage is closed, the ink can be completely prevented from leaking. Further, by increasing the number of rollers, the pump efficiency of the tube pump 8 can be improved. FIG. 7 shows another embodiment (second embodiment) in which three rollers and three recessed portions are provided.

The tube pump according to the present invention is not limited to the one shown in the embodiments in which the tube 14 is curved into a U shape. Alternatively, the tube pump may adopt a structure in which circularly curved tubes are drawn out in opposite directions so as to cross each other, or a structure in which two ends of a circularly curved tube are drawn in one direction so as to be bundled on one plane.

Further, in the ink jet recording device, application of the structure of the tube pump 8 of the present invention is not limited to a delivery pump for supplying the ink from the main tank 5 to the sub-tank 9. Alternatively, the structure can be applied to a suction pump (suction pump 4 of FIG. 1) for removing contaminants and the like precipitated inside the recording head 1 (cleaning operation), a pressuring pump (pressuring pump 13 of FIG. 1) for preferably finishing a meniscus formed on a nozzle surface of the recording head 1, or the like. Further, by increasing the rollers in number without increasing the recessed portion in number (i.e., providing one recessed portion and four rollers), further higher ultimate pressure can be obtained, thereby improving the pump efficiency. As a result, the tube pump of this structure can be used in various positions in the ink jet recording device for various purposes, thereby reducing components in number. Thus, by using the tube pump having a simple structure, an ink jet recording device which expresses a desired suction force and has a higher durability and reliability, can be realized.

INDUSTRIAL APPLICABILITY

According to the structure as described above, the tube pump of the present invention can express a desired suction force during operation, and the negative pressure inside the ink supply passage 7 can be eliminated with the simple mechanism and operation during stoppage for replacing the main tank. Further, it is possible to reliably prevent air from entering the ink supply passage 7 connecting the main tank 5 and the sub-tank 9 from the atmosphere when the main tank 5 is replaced. Accordingly, an ink jet recording device can be realized in which the ink can be stably jetted from the nozzle of the ink jet recording head 1.

The invention claimed is:

1. A tube pump, comprising:

a pump main body having an inner space portion defined by a circular arc-shaped guiding member formed on an inner circumference of the pump main body over a predetermined angle range and an opening portion communicating with the space portion;

an elastic tube extending along the guiding member and out from the opening portion;

at least one pressing member rotationally driven around a shaft coaxial with the guiding member for pressing the tube against the guiding member;

driving means for controlling the rotational drive; and flow passage securing means provided along the guiding member for securing a flow passage inside the tube when the pressing member is not being rotationally driven.

2. A tube pump according to claim 1, wherein the flow passage securing means comprises at least one recessed portion at which the tube is not pressed by the guiding member and the pressing member.

3. An ink jet recording device for performing recording onto a recording medium by jetting ink from recording means, comprising the tube pump according to claim 1, for delivering the ink in an ink supply passage.

4. A tube pump according to claim 1, further comprising position detection means for detecting a position of the pressing member.

5. A tube pump according to claim 2, wherein the number of pressing members is two.

6. A tube pump according to claim 2, wherein the number of pressing members is the same as the number of recessed portions or larger than the number of the recessed portions by one.

7. A tube pump, comprising:

a pump main body having an inner space defined partly by a circular arc-shaped guide surface that extends around an inner circumference of the pump main body over a prescribed angle, and two openings extending through the pump main body and communicating the inner space with outside the pump main body;

an elastic tube connectable to a source of fluid during use of the tube pump and extending lengthwise through one opening into the inner space, along the guide surface, and out of the inner space through the other opening; and at least one pressing member mounted to undergo rotation within the inner space so that during each cycle of rotation, each pressing member progressively presses and elastically deforms the tube against the guide surface to pump fluid through the tube;

wherein the guide surface has at least one recessed portion which is opposed to a section of the tube and at which the tube is not pressed against the guide surface by the pressing member.

8. A tube pump according to claim 7; wherein the number of pressing members is two.

9. A tube pump according to claim 8; wherein the pressing members comprise pressing rollers.

10. A tube pump according to claim 7; wherein the number of pressing members is the same as the number of recessed portions.

11. A tube pump according to claim 7; wherein the number of pressing members is larger than the number of recessed portions.

12. A tube pump according to claim 7; wherein each pressing member comprises a pressing roller.

13. A tube pump according to claim 11; further comprising a rotatable plate member on which each pressing member is mounted; and a motor connected to rotationally drive the plate member to thereby rotate each pressing member within the inner space.

14. A tube pump according to claim 13; further comprising a position detector that detects when each pressing member is in a predetermined position during rotation thereof; and a controller that controls the stop position of the motor based on an output from the position detector.

15. A tube pump according to claim 7; wherein each pressing member rotates about a common axis that is coaxial with the circular arc-shaped guide surface.

* * * * *